US005471847A

United States Patent [19]

Murray et al.

[11] Patent Number: 5,471,847

[45] Date of Patent: Dec. 5, 1995

[54] WEB COOLING DEVICE

[75] Inventors: Robert R. Murray, Madbury; Dale H. Jackson, Newmarket; Eugene J. Bergeron, Dover, all of N.H.; Richard J. Wimberger, DePere, Wis.

[73] Assignees: W. R. Grace & Co - Conn.; Harris Graphics, both of Dover, N.H.

[21] Appl. No.: 371,099

[22] Filed: Jan. 11, 1995

Related U.S. Application Data

[63] Continuation of Ser. No. 56,136, Apr. 30, 1993.

[51] Int. Cl.[6] ..... B30B 3/04; B30B 15/34

[52] U.S. Cl. ..... 62/91; 62/64; 62/374; 100/93 RP; 34/392; 34/393

[58] Field of Search ..... 62/91, 92, 63, 62/64, 373, 374, 375; 34/382, 393; 162/206, 207; 100/38, 93 RP

[56] References Cited

U.S. PATENT DOCUMENTS

| | | | |
|---|---|---|---|
| 2,157,388 | 5/1939 | MacArthur | 34/13 |
| 2,241,554 | 5/1941 | Lang et al. | 91/48 |
| 2,661,669 | 12/1953 | Friedrich, Jr. | 34/13 |
| 2,998,327 | 8/1961 | Catallo | 117/68 |
| 3,198,199 | 8/1965 | Schultz | 134/122 |
| 3,948,721 | 4/1976 | Winheim | 162/207 |
| 4,359,873 | 11/1982 | Miller | 62/63 |
| 4,646,540 | 3/1987 | Blackwood et al. | 62/373 |
| 4,689,895 | 9/1987 | Taylor et al. | 321/20 |
| 4,702,015 | 10/1987 | Taylor et al. | 34/20 |
| 4,738,197 | 4/1988 | Malkia | 100/38 |
| 4,763,424 | 8/1988 | Taylor et al. | 34/20 |
| 5,121,560 | 6/1992 | Daane et al. | 34/13 |

FOREIGN PATENT DOCUMENTS

| | | |
|---|---|---|
| 941065435 | 9/1994 | European Pat. Off. . |
| 3207463 | 3/1982 | Germany . |
| 3241117 | 11/1982 | Germany . |
| 61-20655 | 9/1986 | Japan . |
| 467159 | 1/1969 | Switzerland . |

*Primary Examiner*—Henry A. Bennet
*Assistant Examiner*—William C. Doerrler
*Attorney, Agent, or Firm*—Hugh D. Jaeger

[57] ABSTRACT

Web cooling device where liquid is applied to both sides of a hot web to enhance cooling via evaporation of the liquid from the web.

7 Claims, 8 Drawing Sheets

WEB COOLING DEVICE

This application is a continuation of application Ser. No. 08/056,136, filed Apr. 30, 1993.

BACKGROUND OF THE INVENTION

1. Field of the Invention

The present invention pertains to a process for cooling a web, and more particularly, pertains to a latent web cooling process and apparatus for cooling a web.

2. Description of the Prior Art

Prior art devices have cooled via conduction or convection which could be either too fast or too slow causing undesirable capital expenditure in terms of cost and product quality problems, such as loss of gloss or generation of smoke from continued solvent evaporation.

The present invention overcomes the inadequacies of the prior art by cooling the web primarily via evaporation of liquid, rather than through conduction or convection, thereby allowing moisture availability to the web, which minimizes web shrinkage and fluting, and minimizes static electricity in the web. The web, in an offset dryer, is dried to as low as 2% moisture; and therefore, absorbs water from room air bringing its moisture level back to 4–6%. This is accomplished more readily in the presence of a more available water or other liquid source, such as the present invention provides.

SUMMARY OF THE INVENTION

The general purpose of the present invention is to provide a process for cooling a hot web. Liquid is applied to one or both sides of a hot web by liquid applicator rolls on opposing sides of a traversing web after a web has traveled through a web dryer. Evaporation of the liquid from one or both sides of the web provides for the cooling of the web.

According to one embodiment of the present invention, there is provided an enclosure adjacent to a dryer whereby a hot web passes from the dryer through the enclosure. The enclosure includes a nip roller, a backup roll, liquid applicator rolls and a chill roll, each of which the web passes over.

A significant aspect and feature of the present invention is the cooling of a web by a cooling process whereby liquid, such as water, is applied to a web at a temperature lower than that of the web. In the preferred embodiment, the temperature of the web relative to that of the liquid is such that evaporating cooling results, thereby utilizing the latent heat of vaporization.

BRIEF DESCRIPTION OF THE DRAWINGS

Other objects of the present invention and many of the attendant advantages of the present invention will be readily appreciated as the same becomes better understood by reference to the following detailed description when considered in connection with the accompanying drawings, in which like reference numerals designate like parts throughout the figures thereof and wherein.

DESCRIPTION OF THE PREFERRED EMBODIMENTS

Figure 1:
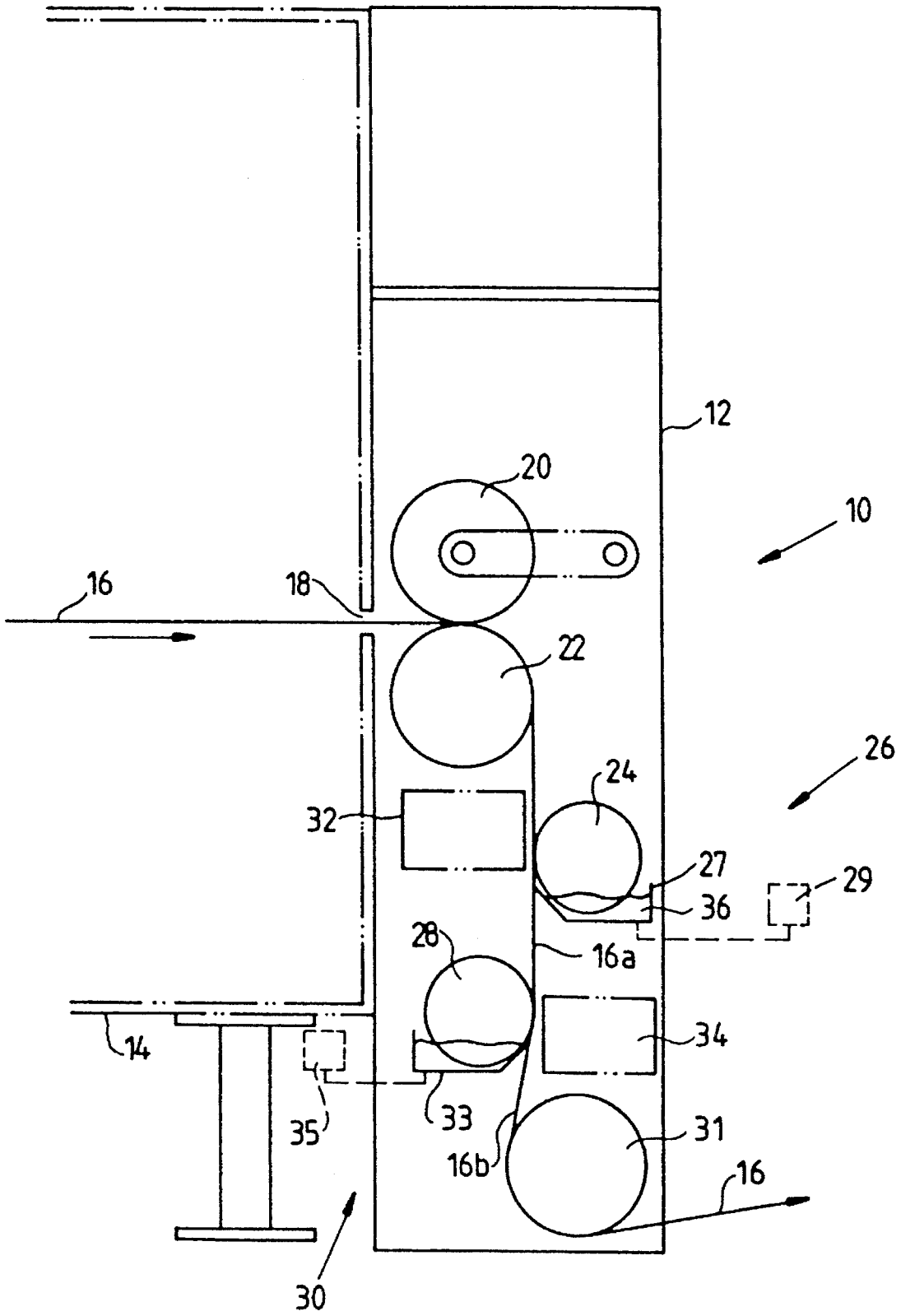
FIG. 1 illustrates a plan view of a liquid applicator device.

FIG. 1 illustrates a plan view of a liquid applicator device 10 for application of water to both sides of a hot web 16 for subsequent cooling by an evaporative process of the web. An enclosure 12 is aligned adjacent to a web dryer 14, and includes a number of vertically aligned components contained therein as now described in detail. A hot web 16 passes through a slotted hole 18 in the web dryer 14 and into the interior of the enclosure 12 where it first passes between a nip roller 20, and a backup roll 22. The hot web 16 then passes over a liquid application roll 24, which communicates with a liquid reservoir 26, including a pan 27 and a feed tank 29, and constantly keeps the surface of the liquid application roll 24 and one side **16*a* of the web 16 wet. The web 16 then passes over another liquid application roll 28, which communicates with a liquid reservoir 30, including a pan 33 and a feed tank 35, and keeps the surface of the liquid application roll 28 and the other side 16*b* of the web 16 wet. In the following Figures reference to a liquid reservoir indicates a reservoir which includes a pan and a feed tank. The web 16 then passes about a chill roll 31 and exits the enclosure 12 whereby the evaporative process provides for cooling about both sides of the hot web 16. Motors 32 and 34 drive the liquid application rolls 24 and 28**, respectively.

Differing amounts of liquid can be transferred to the web depending on the roll speed, surface characteristics of the roll, whether the roll is etched in different patterns or smooth, and whether the roll rotates in the web direction of travel or against the web direction of travel. Also, varying amounts of liquid are applied by the roll depending on roll diameter in relation to the web speed, and, on the depth of the liquid in the reservoir.

Figure 2:
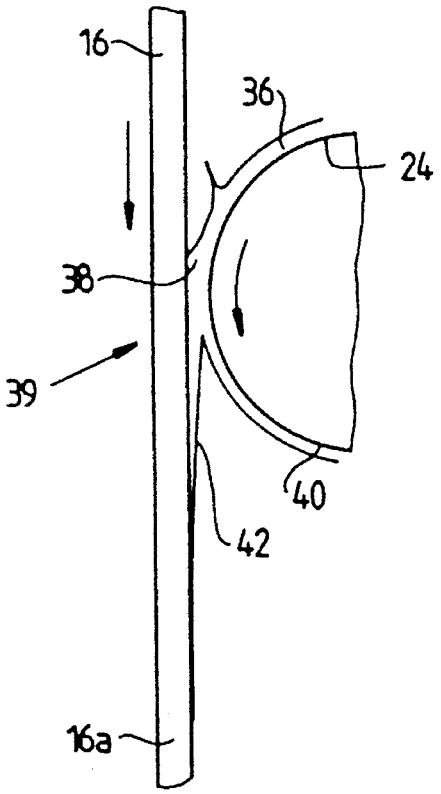
FIG. 2 illustrates the application of a cool liquid to a hot web.

FIG. 2 illustrates the application of a cool liquid 36 to the hot web 16 from the liquid application roll 24 where all numerals correspond to those elements previously described. The cold liquid 36, riding on the liquid application roll 24, is raised immediately to boiling point area 38 at the junction 39 upon contact with the hot web 16, and is partially absorbed by the hot web 16 whereupon the evaporative process causes cooling of the hot web 16. A portion of the liquid 36 remains on the liquid application roll 24 as return liquid 40 which re-enters the liquid reservoir 26. A small portion of the liquid 36 remains on the surface of the hot web 16 at point 42, and is evaporated off as part of the evaporative cooling process to provide a cool web at point **16*a***.

Since the portion of the liquid 36 that remains on the liquid applicator roll 24 and becomes return liquid 40 is typically at a higher temperature than that of the liquid reservoir 26, the temperature of the liquid reservoir 26 may eventually increase to an undesirable level. Accordingly, means can be employed to maintain the liquid reservoir temperature at an appropriate level, such as by periodically or continuously adding additional cooling liquid thereto or by using a heat exchanger in the pan, the tank or the applicator roll (not illustrated).

Figure 3:
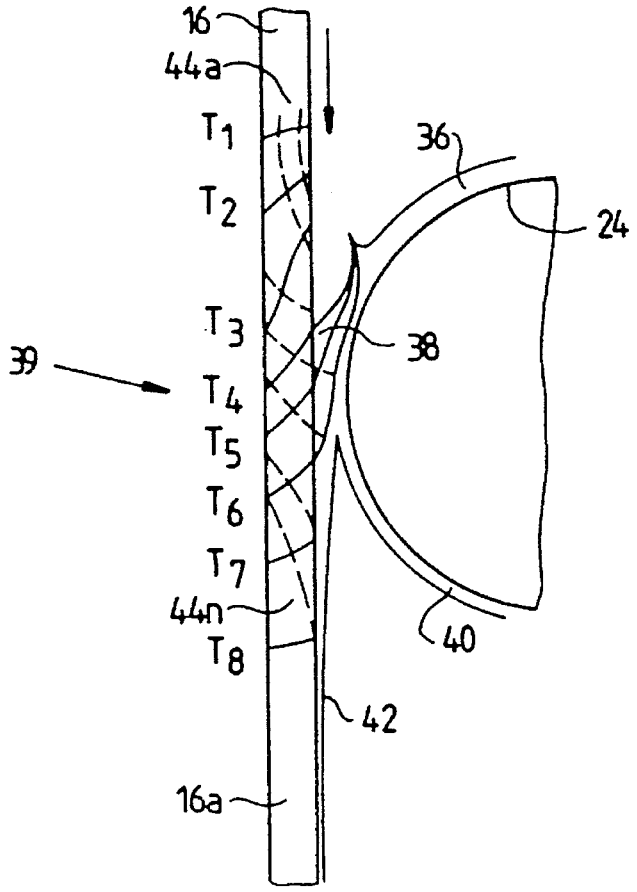
FIG. 3 illustrates a view similar to that of FIG. 2 illustrating a temperature profile and heat flow at a web liquid junction.

FIG. 3 illustrates a view similar to that of FIG. 2 illustrating a temperature profile and heat flow in the web liquid junction 39 where all numerals correspond to those elements previously described. $T_1$ through $T_8$ represent the temperature gradient along the hot web 16 extending to the point 16*a* where the web has been cooled by the evaporative process and where $T_1$ is the highest temperature and $T_8$ is the lowest temperature. $T_4$ is at the vaporization temperature which is less than $T_1$–$T_3$. A large temperature change in the web occurs over a relatively short distance. The contours of the temperature lines $T_1$–$T_8$ illustrate the different temperature on exact opposing sides of the web 16. Lines 44*a*–44*n* across the temperature lines $T_1$–$T_8$ represent the heat flow in the web 16 and into the liquid 36.

Figure 4:
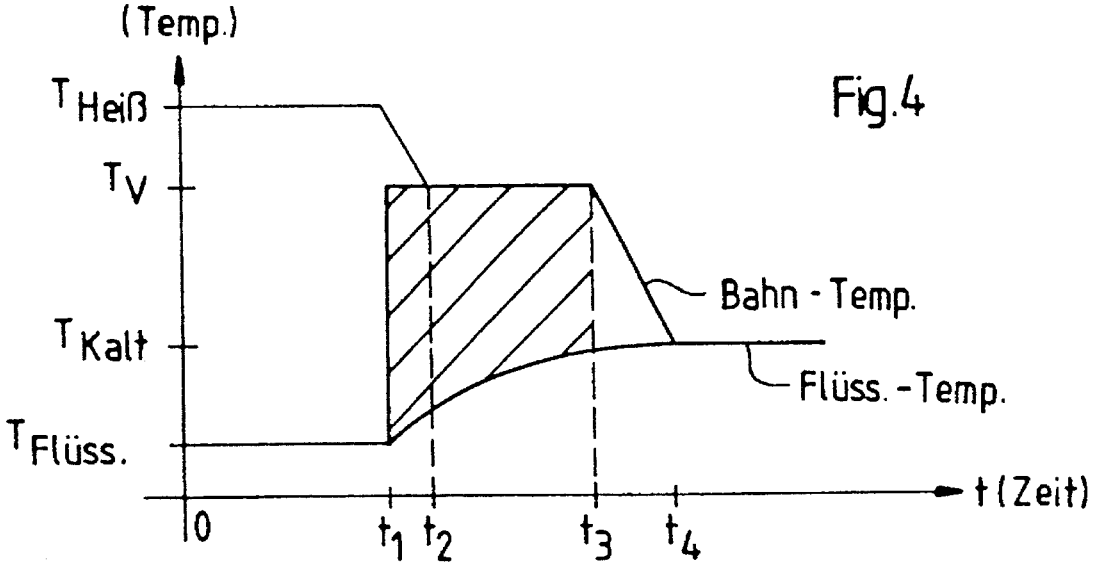
FIG. 4 is a graph illustrating the temperature equalization of a web and fluid.

FIG. 4 is a graph illustrating the temperature equalization of the web and fluid equalization by the hot web 16 flowing into the cool liquid 36 where all numerals correspond to those elements previously described. Table 1 sets forth the time or position of the web versus temperature.

TABLE 1

| Time | Time or Web Position |
|---|---|
| $0$–$t_1$ | Web prior to contact with roll |
| $t_1$–$t_2$ | Web is cooled to vaporization temperature of solution (TV). Solution is vaporizing. |
| $t_2$–$t_3$ | Solution vaporizes absorbing heat from web. |
| $t_3$–$t_4$ | Web and fluid equalize in temperature by heat flowing into liquid. |

MODE OF OPERATION

Figure 5:
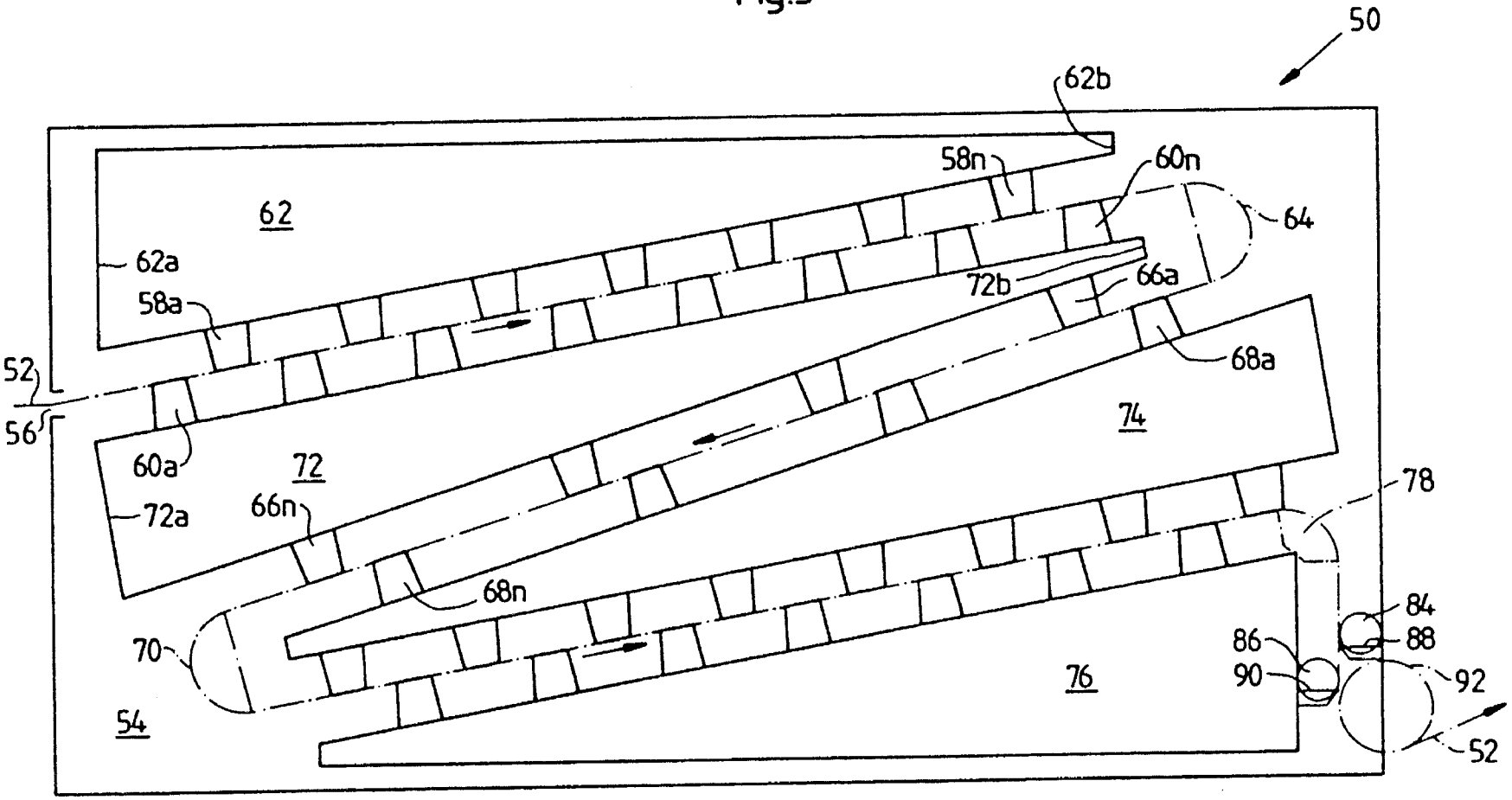
FIG. 5 illustrates a cross section of a working dryer and a web passing therethrough.

FIG. 5 illustrates a cross section of a dryer 50 with a web 52 passing therethrough, as one example of use of the teachings of the present invention and not to be construed as limiting of the present invention. The web 52 enters a drying chamber 54 through a slot 56. Normal air heating and flotation of the web 52 is provided by a series of plenum mounted opposing air bars 58*a*–58*n* and 60*a*–60*n* placed on opposite sides of the web 52. This practice of air flotation of the web is known in the art. The angle with reference to horizontal, which the web travels in this drying chamber, can be any value from vertical to horizontal. This figure shows the angle resulting from keeping the top of the plenum 62 horizontal. An air supporting turning member 64 turns the web 52 direction of travel nearly 180 degrees. The web takes a position from the air bars 58*a*–58*n* and 60*a*–60*n* due to the pressure developed by the air flow from the bars and the tension in the web. This air is heated and continues to heat the web and to remove the evaporating solvents from both sides of the web. Care is exercised in this design to prevent a negative pressure from developing between the bar and the web, and thus, drawing the web down against the bar, rather than pushing it away from the bar. This practice is known in the art. The web 52 then travels between another set of opposing plenum mounted air bars 66*a*–66*n* and 68*a*–68*n* to a second turning member 70.

The plenums 62 and 72 supplying the air to the top and bottom air bars 58*a*–58*n* and 60*a*–60*n* have their widest cross section ends 62*a* and 72*a* and their narrowest cross section ends 62*b* and 72*b* placed together. This allows the output of a single blower to be connected to both the top plenum 62 and the bottom plenum 72 at one end of the web dryer 14, and a second blower to be placed at the other end of the dryer for an identical set of reversed upper and lower plenums 74 and 76. An additional pair of plenums could be arranged to continue in this stacking manner to provide a longer web path, while efficiently utilizing the height. A turning member 78 is located at the exit end of the lower plenum 76, and turns the web path approximately 90 degrees to near vertical. The turning member 78 is designed to function similar to turning members 64 and 70 with the exception of the degree of turning. The height of the entire drying chamber 54 has been minimized by the opposite hand placement of the two sets of upper and lower plenums 62 and 72 and 74 and 76, while encouraging the uniform air flow from the flotation air bars supplied by them. The space between the turning member 64 and 70 is supplied by air from two separately pressured plenums, therefore the opposite web side pressure equilibrium is not precisely preserved. The air bars are therefore spaced further apart and air supply reduced to allow the web to traverse without touching the bars. The scrubbing of vapors and heating of the web are reduced in this section. This reduced capacity is a design tradeoff of small consequence since the two 180 degree turns causes the length of the dryer to be approximately halved. Any heating and scrubbing achieved in this path is a bonus which further reduces the overall length. It is obvious that the heating and scrubbing action are to be maximized in this section.

Rollers 84 and 86 are positioned to allow the uniform application of liquid, such as water or other coating, supplied by pans 88 and 90 to the web 52 at a controlled temperature. More than two rolls and pans can be used in this section. Raising the dryer or directing the web upward at the turning member 78 for additional vertical space can be provided. The roll applicators apply liquid to reduce the web temperature through evaporation. The object is for the web to exit the enclosure at a temperature below where the solvents are appreciably evaporated. For offset printing inks, this temperature is approximately 170 degrees F. The roll 92 is in contact with the web, and turns in the web direction to continue the process through the machine. The roll 92 can also be cooled by circulating internal fluid, thus maintaining a constant temperature surface for the web to contact. Roll 92 then further reduces the temperature by conducting the heat away from the web. The diameter of this roll 92 and the wrap around it is sufficient to smooth any wrinkles which may have developed in the web by the previous process steps. This entire machine has thus eliminated the need for separate chill rolls and applicator rolls subsequent to the dryer. The economy realized is in the floor space, as well as less equipment to be installed. The present inventions of this embodiment can be applied separately without detracting from the primary performance of either of the present inventions.

Figure 6:
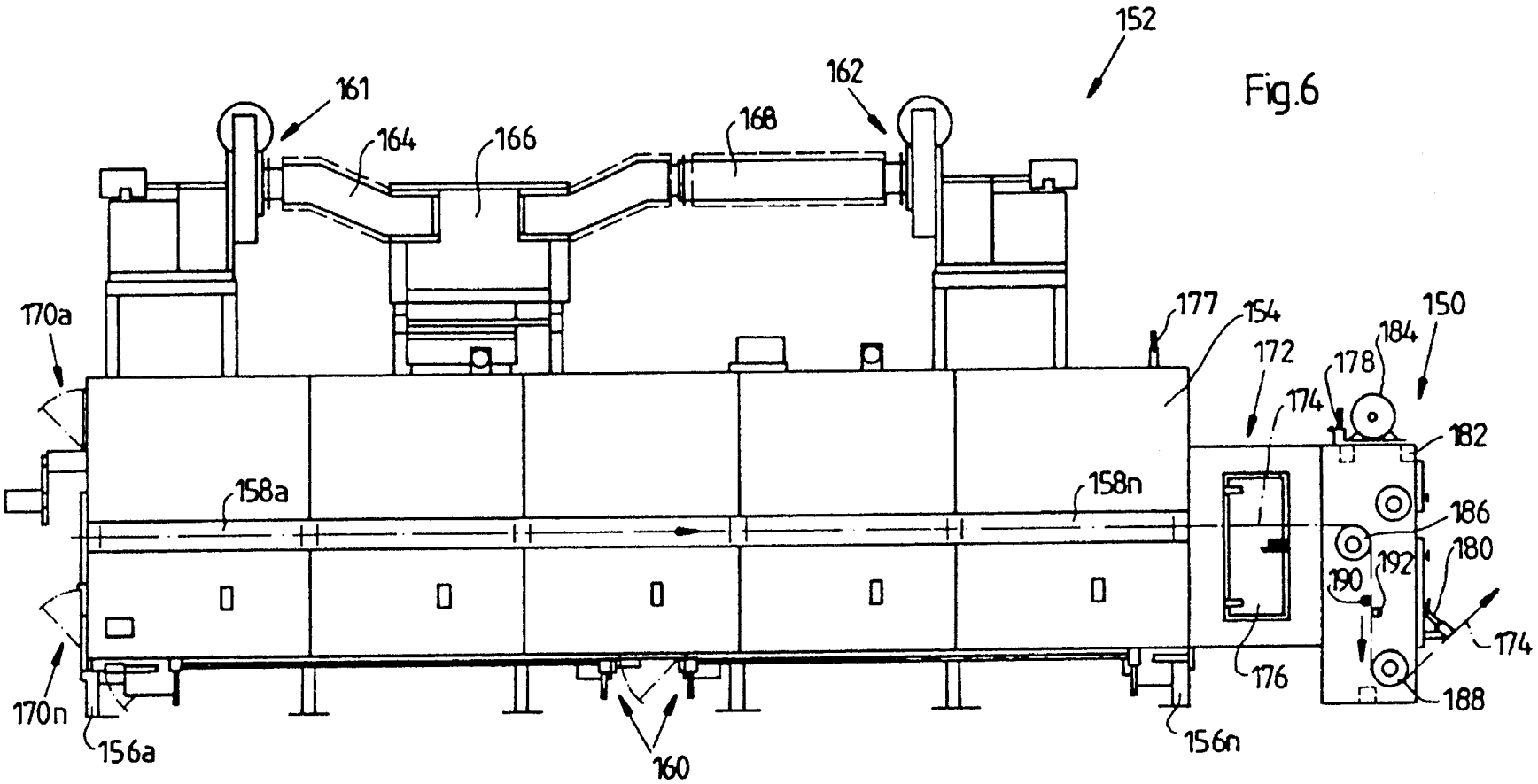
FIG. 6 illustrates the use of a web cooling apparatus with a web dryer.

FIG. 6 illustrates the use of a web cooling apparatus 150 in use with a web dryer 152. The web dryer 152 includes a drying enclosure 154 supported by a plurality of support legs 156*a*–156*n*. A plurality of web up-doors 158*a*–158*n* align along the side, face, and like header retraction systems 160 is included on the under side of the drying enclosure 154.

Burner combustion air fans 161 and 162 mount on the dryer enclosure 154, and furnish combustion air to the burners mounted on the back of the dryer enclosure 154 through duct systems 164, 166 and 168. Explosion venting and access doors 170*a*–170*n* are located at the bottom, back, right and left ends of the drying enclosure 154. A transition chamber 172 is located between the web dryer 152 and the web cooling apparatus 150. The transition chamber 172 contains solvent residues as the web 174 passes through, which can be exhausted as is known in the art. An access door 176 is located on the transition chamber 172. Infrared pyrometers 177, 178 and 180 mount on the dryer enclosure or web cooling apparatus enclosure 182 to measure temperatures as the web 174 passes from the drying enclosure 154 through the web cooling apparatus 150. A motor 184 rotatably drives an upper chill roller 186 and a lower chill roller 188 and other components as described in FIG. 7. Upper and lower liquid application rolls 190 and 192, including reservoirs as previously described, align between the upper and lower chill rolls 186 and 188 for applying of liquid to the web 174.

Figure 7:
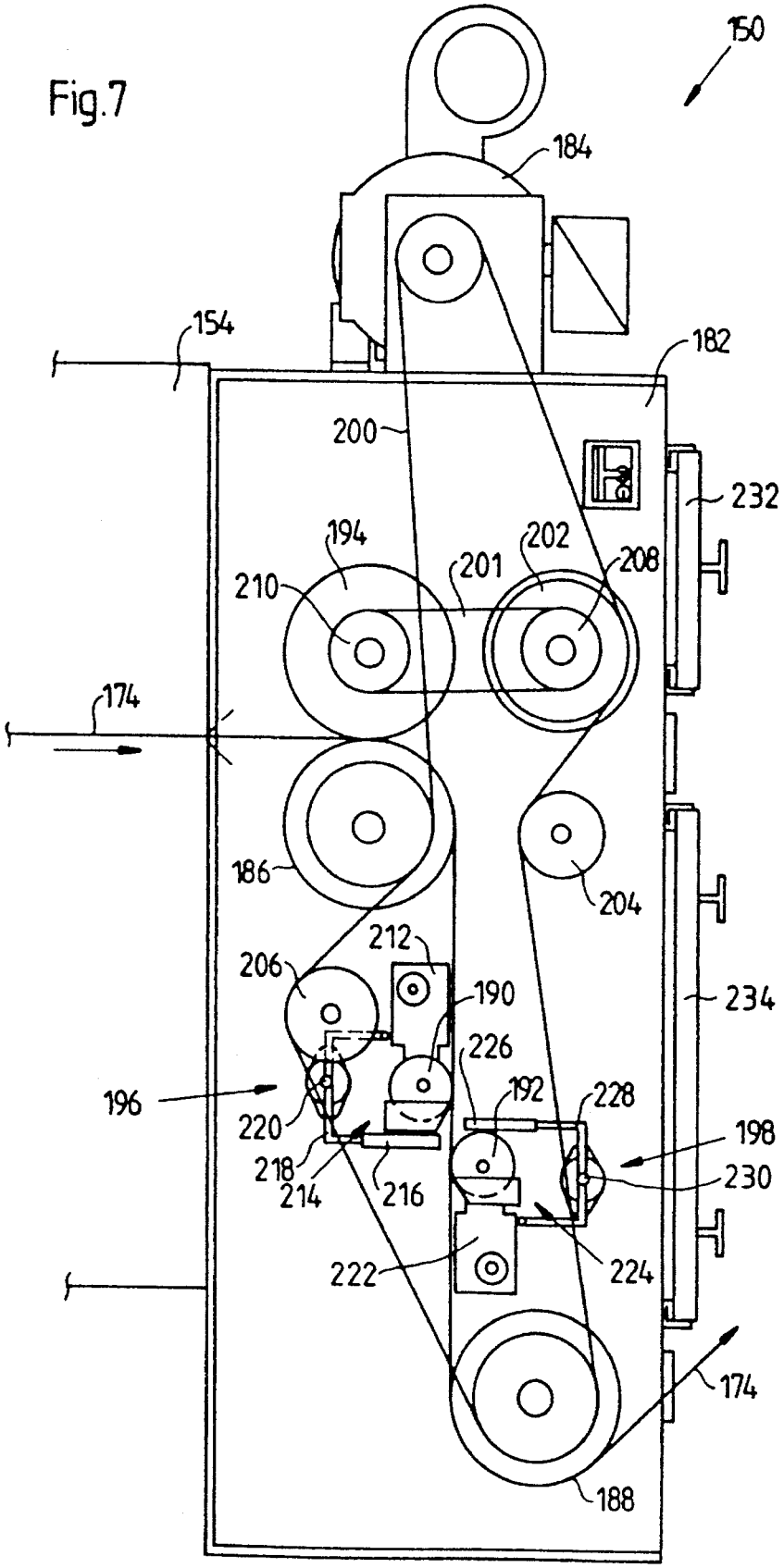
FIG. 7 illustrates the web cooling apparatus.

FIG. 7 illustrates the web cooling apparatus 150. Various components mount on and about an enclosure 182 including an upper chill roll 186, a chilled nip roll 194, a lower chill roll 188, an upper liquid application assembly 196, and a lower liquid application assembly 198. A drive motor 184 is secured to the top of the enclosure 182 and includes a drive belt 200 which passes about a clutch assembly 202, a fixed tension wheel 204, the lower chill roll 188, an adjustable idler pulley 206, and the upper chill roll 186. The belt 201 is included between the clutch assembly 202 and the chilled nip roll 194 on drive pulleys 208 and 210.

The upper application assembly includes a liquid application roll 190 mounted on a pivot arm 212. The liquid application roll 190 aligns in a reservoir 214. The reservoir tanks are not illustrated for purposes of brevity and clarity. A pneumatic cylinder 216 actuates a linkage 218 about a pivot point 220 to laterally move and adjust the pivot arm 212 and the liquid application roll 190 so that the wetted liquid roll can make a pressure contact against the warm web 174 passing between the upper chill roll 186 and the lower chill roll 188. The lower application is similar in function and design, and includes a liquid application roll 192 mounted on a pivot arm 222, a reservoir 224, a pneumatic cylinder 226, a linkage 228 and a pivot point 230. Upper and lower doors 232 and 234 provide access to the interior of the framework cabinet.

An Example

The optimal liquid temperature is typically 80 degrees F or below. This is necessary to remove heat transferred from the web to the applicator rolls 190 and 192. If the applicator rolls 190 and 192 get too warm, ink transfers from the web 194 and sticks to the applicator rolls 190 and 192. The critical temperature for the applicator rolls 190 and 192 depends on the ink formulation, and is generally about 140 degrees F.

Web temperature before the applicator rolls 190 and 192 is typically between 240 degrees F and 325 degrees F. Web temperature after both applicator rolls and any subsequent chill rolls needs to be below approximately 170 degrees F as previously discussed.

A continuous supply of liquid is needed for the reservoirs 214 and 224 because a fluctuating liquid level would cause varying amounts of liquid to be applied to the web. This is typically accomplished by supplying an excess volume of liquid with a pump that discharges the liquid through a flow diffusing baffle into the reservoir. The excess liquid leaves the pan over a weir or standpipe, and returns to a main reservoir such as a tank, which supplies the pump. The tank can be replenished by either a continuous or batch process, such as a float valve or electronic level sensors and a solenoid valve. A heat exchanger can be used or sufficient warm liquid replaced with cool liquid to maintain the temperature requirements as discussed above. Liquid returning to the tank from the pan of the reservoir system may contain paper fibers or condensed ink solvent oil that preferably should be filtered out before recirculating.

The applicator roll diameter for a 56 inch wide machine is 4 inches. The diameter is not critical, but is a compromise of adequate size to resist deflection, enough radius to provide a comfortable clearance from the web to the pan, enough radius to provide a preferred contact area to the web without excessive web deflection or force against the web, and a physical size to facilitate mechanical layout. This places the practical size in the range of from about 3 inches to about 6 inches.

The liquid level in the reservoir pans 214 and 224 is deep enough to immerse the applicator rolls 190 and 192 to approximately ¼ to ⅓ of its diameter by way of example and for purposes of illustration only and not to be construed as limiting of the present invention. This allows the roll journals to extend beyond the pan without the need for seals to prevent liquid leakage, while still providing adequate surface area to transfer heat from the roll to the liquid. Total volume of the reservoir pans is kept small to minimize weight, as the reservoir pans move with the rolls 190 and 192 to engage the web. Small volume also encourages liquid circulation to maintain uniform temperature of the liquid and roll. The liquid level does affect the time and distance that the liquid film is on the roll, and thus, the thickness of the liquid film as the liquid is applied to the web. For this reason, a constant liquid level is important.

During testing, in one example, a roll speed of 55 rpm, rotating against the web, supplied sufficient liquid to a 3000 fpm web. Roll speed was controlled to be a fixed percentage of web speed. Maximum liquid application was limited by final web moisture. Increasing web moisture generally improved handling in the folder section of the press line, but excessive web moisture caused cutting problems in the folder. Thus, the preferred roll speed is as fast as the rest of the process allows. The applicator rolls were retracted from the web at web speeds below 1000 fpm.

DESCRIPTION OF THE ALTERNATIVE EMBODIMENTS

Figure 8:
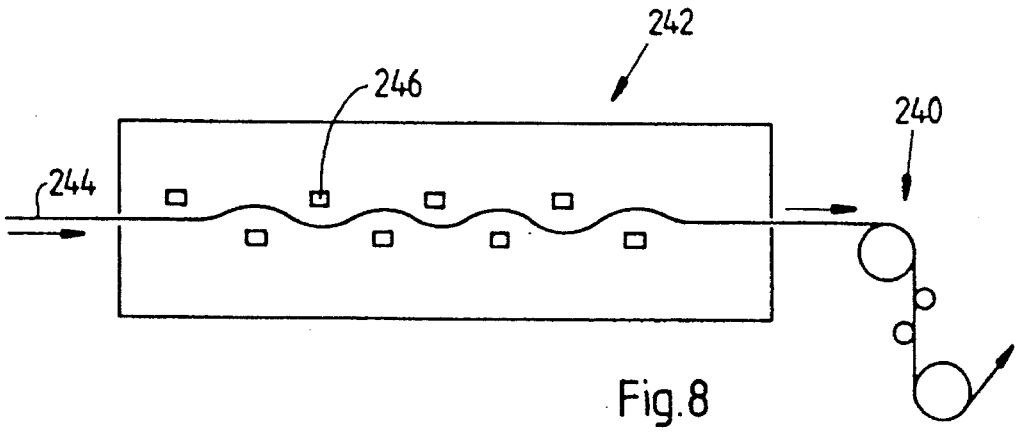
FIG. 8 illustrates an alternative embodiment of a web cooling apparatus and dryer aligned horizontally.

FIG. 8, an alternative embodiment, illustrates a web cooling apparatus 240 and dryer 242 where a web 244 is aligned horizontally between a set of horizontally aligned and opposing air bars 246 and is cooled by a web cooling apparatus 240.

Figure 9:
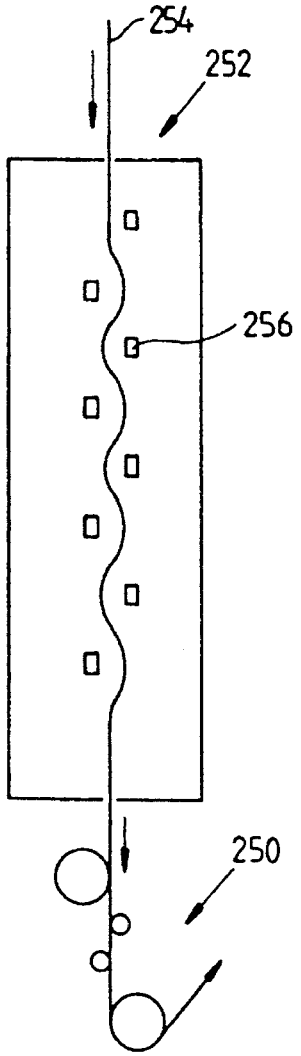
FIG. 9 illustrates a second alternative embodiment of a web cooling apparatus and a dryer aligned vertically.

FIG. 9, a second alternative embodiment, illustrates a web cooling apparatus 250 and a dryer 252 where a web 254 is aligned vertically between a set of vertically aligned and opposing air bars 256 and is cooled by the web cooling apparatus 250.

Figure 10:
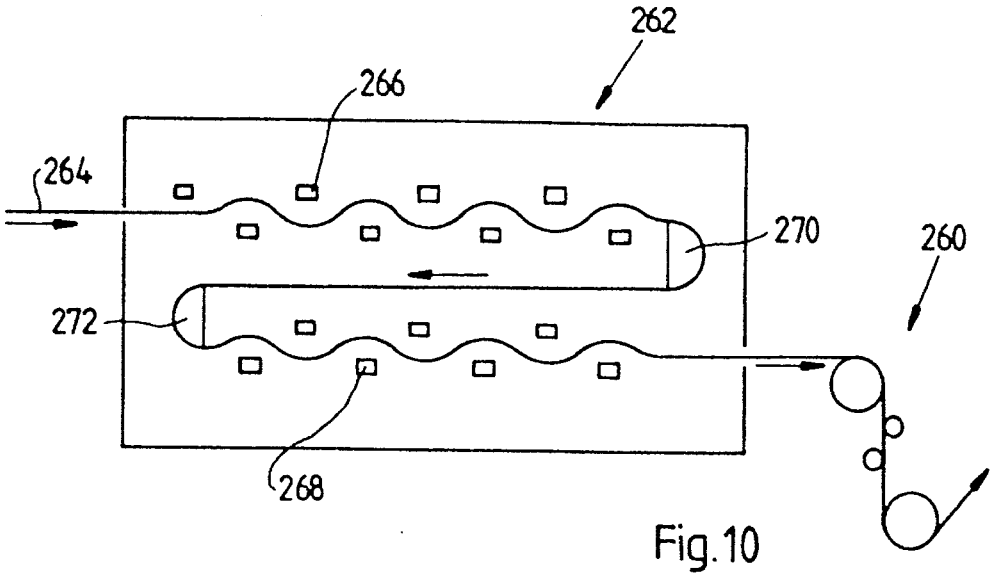
FIG. 10 illustrates a third alternative embodiment of a web cooling apparatus and a dryer; and, FIG. 11 illustrates a fourth alternative embodiment of a web cooling apparatus and a dryer.

FIG. 10, a third alternative embodiment, illustrates a web cooling apparatus 260 and a dryer 262 where a web 264 is aligned horizontally between upper and lower sets of horizontally aligned and opposing air bars 266 and 268, and about turning members 270 and 272, and then cooled by the web cooling apparatus 260.

Figure 11:
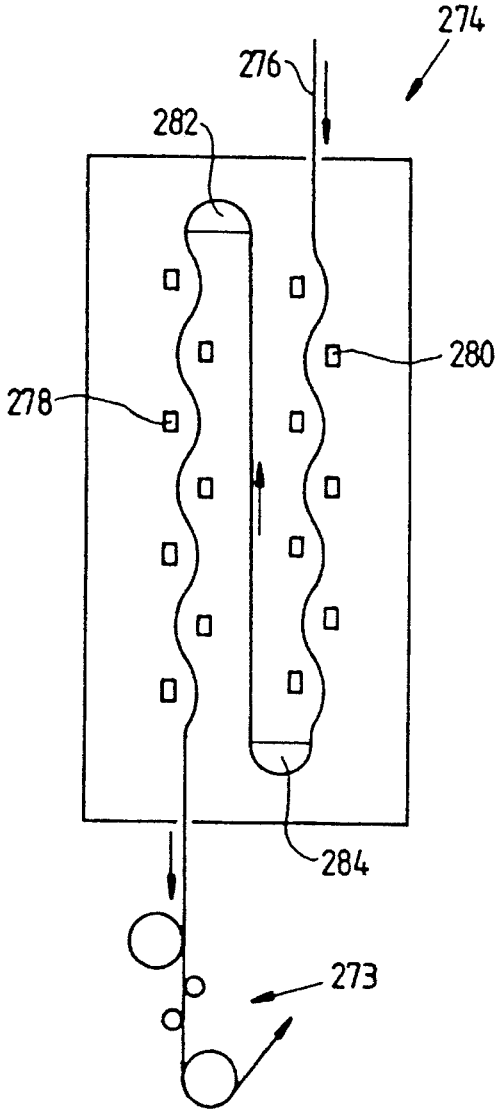

FIG. 11, a fourth alternative embodiment, illustrates a web cooling apparatus 273 and a dryer 274 where a web 276 is aligned vertically between left and right sets of vertically aligned and opposing air bars 278 and 280 and about turning members 282 and 284 and then cooled by the web cooling apparatus 273.

Various modifications can be made to the present invention without departing from the apparent scope hereof.

We claim:

1. Process for cooling a web comprising the steps of:

a. providing a liquid application roll;

b. passing a hot web against said roll; and, c. passing said hot web against a chill roll, thereby providing an evaporative process for cooling said web.

2. The process of claim 1 wherein the liquid is applied to enhance the appearance or quality of the paper or the image contained on it.

3. Process for cooling a web comprising the steps of:

a. providing a first liquid application roll in a reservoir;

b. passing a hot web over said roll and wetting one side of said web;

c. providing a second liquid application roll in a reservoir; and, d. passing said hot web over said roll and wetting another side of said web, whereby an evaporative process provides for cooling about both sides of said hot web.

4. The process of claim 3 wherein the liquid is applied to enhance the appearance or quality of the paper or the image contained on it.

5. The process of claim 3, further comprising the step of passing said hot web against a chill roll.

6. A process for cooling a web comprising the steps of:

a. providing a liquid application roll partially submerged in a pan containing cooling liquid at a temperature lower than that of the web;

b. passing a hot web vertically downward against the rotating roll so that a pre-determined amount of liquid is applied to the first side of the web by the roll;

c. cooling the web by evaporation of the liquid from the first side of the web;

d. providing a second liquid application roll partially submerged in a second tray of cooling liquid at a temperature lower than that of the web;

e. passing the hot web vertically downward against the second liquid application roll for applying a pre-determined amount of cooling liquid to a second side of the web; and, f. cooling the web by evaporation of the liquid from the second side of the web.

7. The process of claim 6, further comprising passing the web over a chill roll to further cool the web.

* * * * *